US008136678B2

(12) United States Patent
Moss

(10) Patent No.: US 8,136,678 B2
(45) Date of Patent: Mar. 20, 2012

(54) MERCHANDISE DISPLAY SUPPORT STAND

(76) Inventor: Glenn Edward Moss, Maple (CA)

( * ) Notice: Subject to any disclaimer, the term of this patent is extended or adjusted under 35 U.S.C. 154(b) by 350 days.

(21) Appl. No.: 12/460,212

(22) Filed: Jul. 16, 2009

(65) Prior Publication Data

US 2011/0011814 A1 Jan. 20, 2011

(51) Int. Cl.
*A47G 29/00* (2006.01)

(52) U.S. Cl. ..... 211/73

(58) Field of Classification Search ..... 211/73, 211/149, 174, 85, 132.1, 130.1, 195, 126.6, 211/126.16, 135; 108/99; 248/166
See application file for complete search history.

(56) References Cited

U.S. PATENT DOCUMENTS

| | | | | | |
|---|---|---|---|---|---|
| 740,927 | A | * | 10/1903 | Roberts | 211/73 |
| 1,002,633 | A | * | 9/1911 | Boos | 211/73 |
| 1,069,770 | A | * | 8/1913 | Doering | 211/73 |
| 1,379,739 | A | * | 5/1921 | Bennett | 40/124.06 |
| 1,487,049 | A | * | 3/1924 | Dietsche, Jr. | 248/152 |
| 1,614,265 | A | * | 1/1927 | Stockton | 131/240.1 |
| 1,698,686 | A | * | 1/1929 | Ziemmerman | 108/100 |
| 1,717,456 | A | * | 6/1929 | Lasher, Jr. | 248/174 |
| 1,729,014 | A | * | 9/1929 | Scherotto | 211/73 |
| 1,836,138 | A | * | 12/1931 | Turner et al. | 211/74 |
| 1,841,561 | A | * | 1/1932 | Ward | 211/73 |
| 1,894,902 | A | * | 1/1933 | Carmichael | 211/73 |
| 1,934,312 | A | * | 11/1933 | Lambert | 206/45.21 |
| 1,935,223 | A | * | 11/1933 | Davidson | 248/174 |
| 2,000,870 | A | * | 5/1935 | Ziemmerman | 206/740 |
| 2,002,493 | A | * | 5/1935 | Einson | 229/102.5 |
| 2,049,659 | A | * | 8/1936 | Parrott | 297/440.12 |
| 2,081,070 | A | * | 5/1937 | Schoettle | 206/45.22 |
| 2,135,093 | A | * | 11/1938 | Abrams | 248/152 |
| 2,173,917 | A | * | 9/1939 | Ryan | 211/73 |
| 2,324,232 | A | * | 7/1943 | Pantalone | 211/73 |
| 2,332,804 | A | * | 10/1943 | McCreary | 211/73 |
| 2,391,285 | A | * | 12/1945 | Williamson et al. | 206/565 |
| 2,611,491 | A | * | 9/1952 | Lewis | 211/73 |
| 2,677,469 | A | * | 5/1954 | Ebert | 211/73 |
| 2,940,710 | A | * | 6/1960 | Adams | 248/174 |
| 4,477,016 | A | * | 10/1984 | Growney | 229/120.27 |
| 4,570,805 | A | * | 2/1986 | Smith | 211/149 |
| RE32,668 | E | * | 5/1988 | Smith | 211/149 |
| 5,042,651 | A | * | 8/1991 | Davis et al. | 211/132.1 |
| 5,183,166 | A | * | 2/1993 | Belokin et al. | 211/149 |
| 5,213,220 | A | * | 5/1993 | McBride | 211/132.1 |
| 5,301,800 | A | * | 4/1994 | Kenney | 206/449 |
| 5,826,732 | A | * | 10/1998 | Ragsdale | 211/149 |
| 5,868,367 | A | * | 2/1999 | Smith | 248/174 |
| 6,098,820 | A | * | 8/2000 | Smith | 211/132.1 |
| 6,871,750 | B2 | * | 3/2005 | Moss et al. | 211/149 |
| 7,261,215 | B2 | * | 8/2007 | Moss et al. | 211/149 |
| 7,571,820 | B2 | * | 8/2009 | Alexander | 211/85 |
| 7,905,365 | B2 | * | 3/2011 | Virvo | 211/73 |
| 2005/0184015 | A1 | * | 8/2005 | Cypranowski et al. | 211/73 |
| 2011/0011814 | A1 | * | 1/2011 | Moss | 211/73 |

* cited by examiner

*Primary Examiner* — Sarah Purol
(74) *Attorney, Agent, or Firm* — David W. Wong

(57) ABSTRACT

A merchandise display support stand is formed by a single configuration stamped from a single cardboard. All component parts are formed from the configuration. The stand in the erected condition is formed by folding the configuration along various horizontal and vertical fold lines and it is foldable to a collapsed folded condition. The stand is self-erectable from the folded condition to the erected condition.

15 Claims, 14 Drawing Sheets

MERCHANDISE DISPLAY SUPPORT STAND

FIELD OF THE INVENTION

This invention relates to merchandise display support stands and more particularly to merchandise display support stands which are foldable to a collapsed condition for storage and transportation and self-erectable easily from the collapsed condition to the erected condition usable for supporting a variety of merchandise displays.

BACKGROUND ART

Merchandise items are commonly displayed at retail facilities by placing them directly on a stand or on shelving provided on a stand such that the merchandise items are readily viewable by the purchaser to select and to obtain them for purchase. The support stands may be made with metal, cardboard or corrugated board. Metal support stands are costly to fabricate and difficult to erect. Cardboard display support stands are the most preferred type due to their lower fabrication cost.

However, known cardboard display support stands are composed of a plurality of component parts which are formed in separate processes and then the separate component parts must be glued to a main body of the support stand during fabrication. Such gluing process of a plurality of separate component parts is time consuming and messy to carried out due to the necessity of having to position carefully together all the mating parts properly and securely, and then applying adhesive onto these mating parts, and the time required for the adhesive to set while maintaining the component parts properly engaging with one another.

Another difficulty in the fabrication of cardboard display support stands is that the plurality of separate component parts must be formed separately in several different stamping operations and they must then be assembled together by hand to form the stand. Thus, they are labor intensive to fabricate.

Another drawback of the known display support stands is the difficulty in their erection at the display site since most display support stands are fairly large in physical size such that it is difficult to be handled by one person during their erection. Furthermore, the various component parts must be attached together at the display site to form the support stand; the plurality of these component parts and the bulkiness of the support stand rendering the erection of the support stand time consuming and unwieldy to carry out particularly in a display location of a retail outlet having a relatively little available space for the erection of the display stand.

SUMMARY OF THE INVENTION

It is a principal object of the present invention to provide merchandise display support stands which are simple in structure and easy to fabricate all the component parts in a single cardboard in a single stamping operation.

It is another object of the present invention to provide merchandise display stands which are foldable into a collapsed condition for convenient storage and/or transportation.

It is another object of the present invention to provide merchandise display support stands which can self-erect automatically so that they may be erected quickly and readily from the collapsed condition with ease.

It is another object of the present invention to provide merchandise display support stands which can be erected readily by a single person.

It is yet another object of the present invention to provide merchandise display support stands usable for supporting and displaying a variety of merchandise items.

It is still another object of the present invention to provide merchandise display support stands which can be provided with removable display trays for displaying particularly merchandise items of relatively small physical size.

BRIEF DESCRIPTION OF THE DRAWINGS

The above objects and advantages of the present invention will become apparent from the following detailed description of the preferred embodiments thereof in connection with the accompanying drawings, in which

FIG. 6 is a front perspective elevation view of the merchandise display support stand in a partially collapsed condition with the pedestal shelve folded outward and downward.

DETAILED DESCRIPTION OF THE PREFERRED EMBODIMENTS

Figure 1:
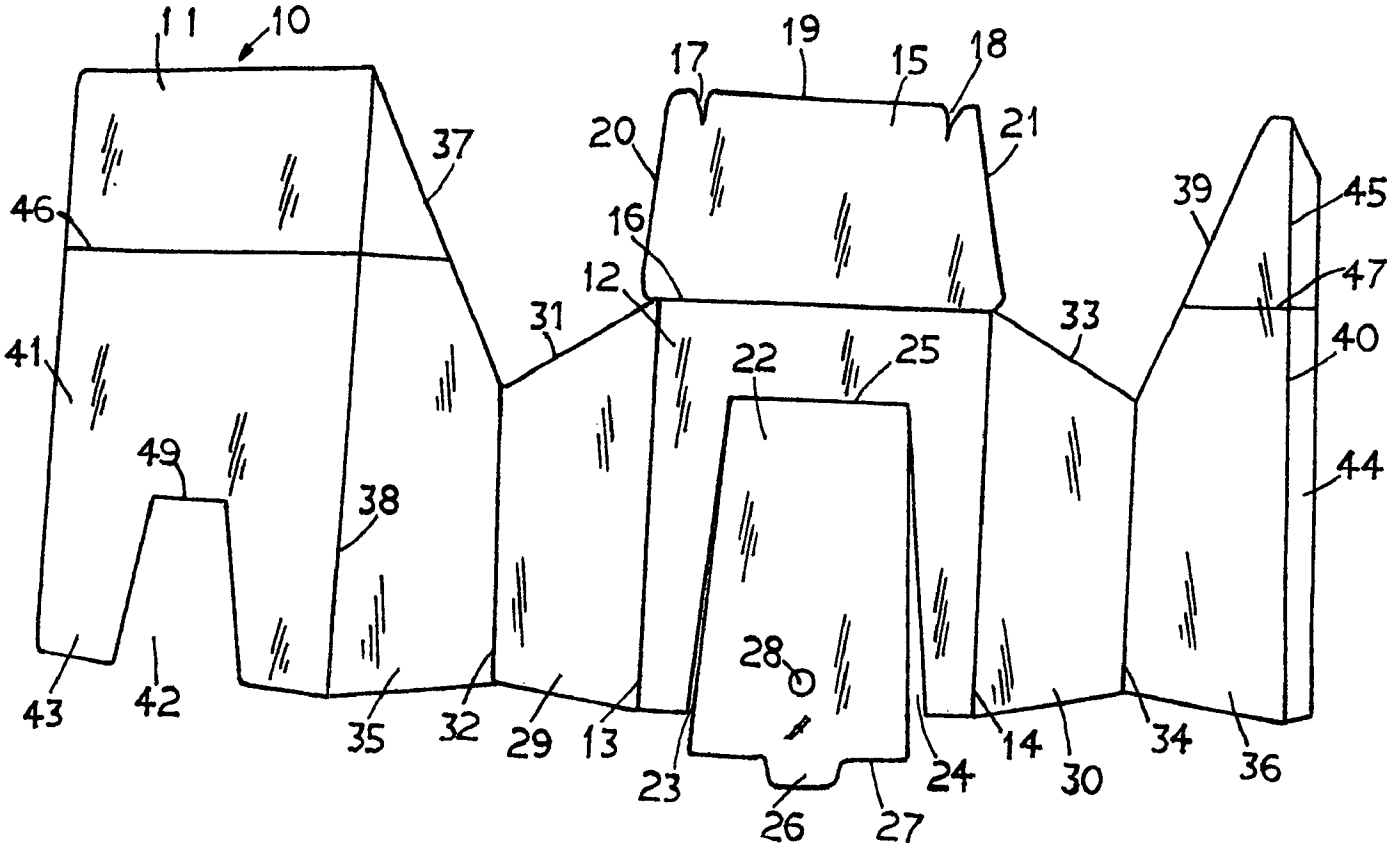
FIG. 1 is a top perspective elevation of the configuration which may be formed in a single stamping operation on a single cardboard to provide all basic component parts required for fabricating the merchandise display support stand of the present invention.
Figure 2:
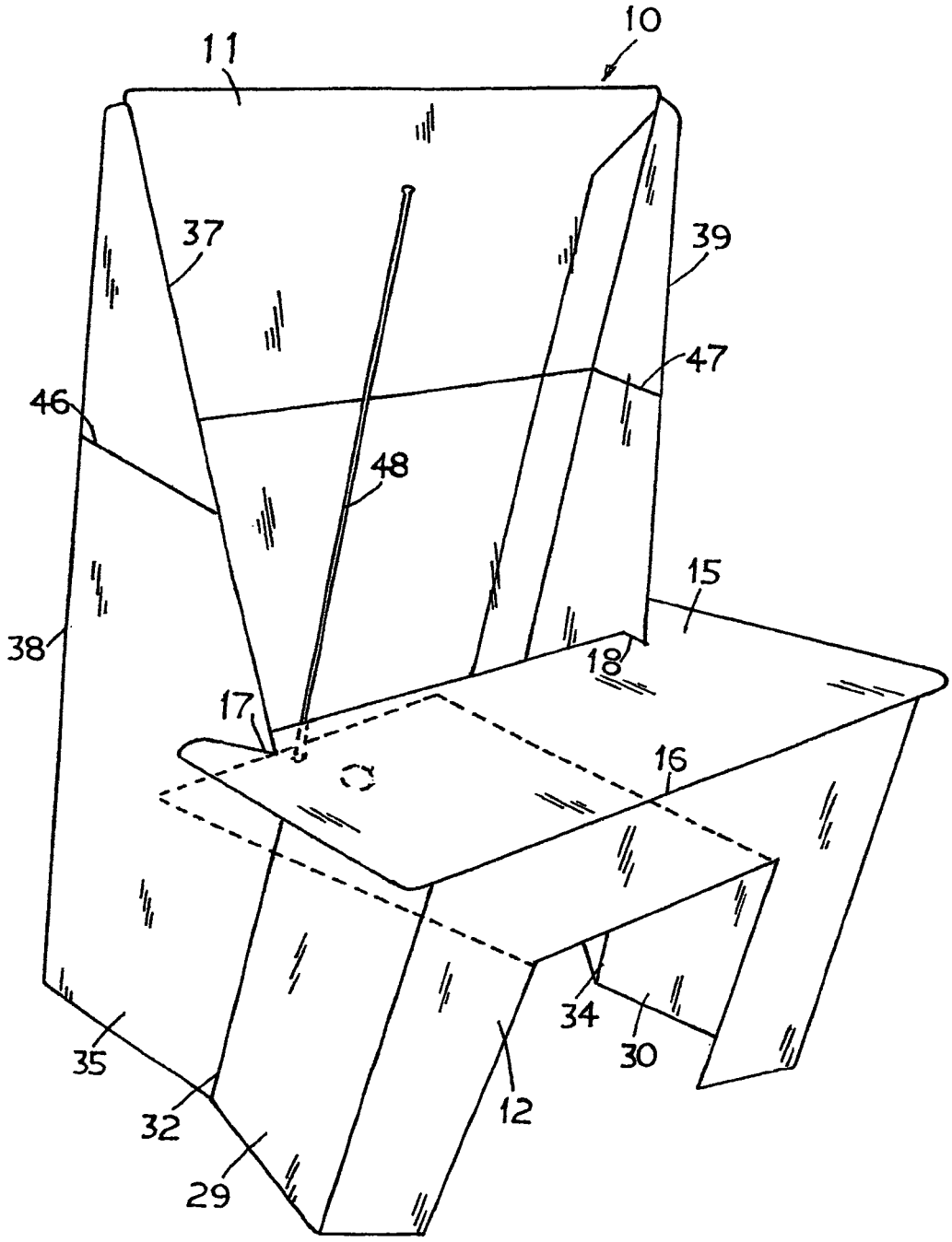
FIG. 2 is a left front and top perspective elevation view of the merchandise display support stand in the erected condition according to the present invention.
Figure 3:
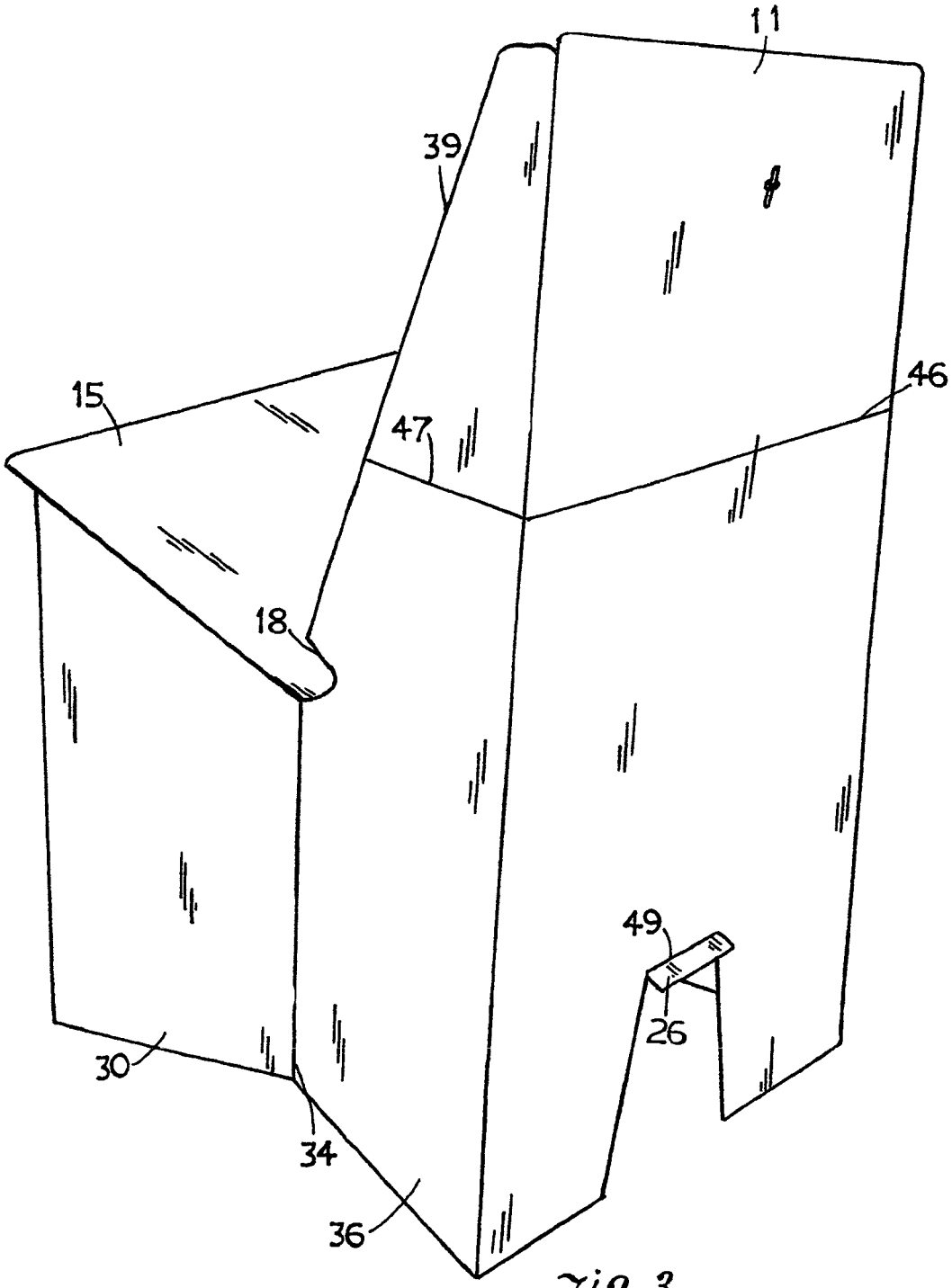
FIG. 3 is a right rear and top perspective elevation view thereof.

With reference to the drawings, the merchandise display stand 10 of the present invention may be readily fabricated by a configuration 11 of all its basic component parts formed in a single cardboard. The configuration 11 has a generally rectangular main portion 12 with two foldable side edges formed by two vertical fold lines 13 and 14. An upper panel 15 extends upwards from a horizontal fold line 16 located at the top edge of the upper panel 15. Two vertical opened slots 17 and 18 are formed at the top edge 19 of the upper panel 15 and they are located opposite to the horizontal fold line 16 and adjacent to the side edges 20 and 21 of the upper panel 15, so that the opened slots 17 and 18 are spaced from each other. A foldable panel 22 is formed at the center of the main portion 12 by stamping two elongated vertical spaced slots 23 and 24 in the main portion 12 such that the foldable panel 22 is foldable relative to the main portion 12 along a horizontal fold line 25. A tab 26 is formed at the middle of the lower edge 27 of the foldable panel 22 and it extends beyond the lower edge of the foldable panel 22. An opening 28 is formed adjacent to the tab 26. The foldable panel 22 may be pivoted relative to the main portion 12 along the horizontal fold line 25 by conveniently inserting a finger into the opening 28 to pivot the foldable bracing panel 22 relative to the main portion 12. A trapezoidal shape panel 29 extends sideway from the vertical fold line 13 of the main portion 12 and another trapezoidal shape panel 30 extends sideway from the vertical fold line 14. The panels 29 and 30 have a mirror image and similar dimensions of one another. The trapezoidal shape panel 29 has a sloping top edge 31 sloping upwards from a vertical fold line 32 to the left outer edge of the horizontal fold line 16. The trapezoidal shape panel 30 also has a sloping top edge 33 sloping upwards from a vertical fold line 34 to the right outer edge of the horizontal fold line 16. An outer trapezoidal shape panel 35 extends sideway from the vertical fold line 32 and another outer trapezoidal shape panel 36 extends sideway from the vertical fold line 34. The outer trapezoidal shape panels 35 and 36 have a height equal to the total height of the main portion 12 and the upper panel 15; and the outer trapezoidal shape panel 35 has a sloping upper edge 37 sloping upwards from the top end of the vertical fold line 32 to the top end of an outer vertical fold line 38 while the outer trapezoidal shape panel 36 has a sloping upper edge sloping upwards from the top end of the vertical fold line 34 to a top end of an outer vertical fold line 40. The outer trapezoidal shape panels 35 and 36 have a mirror image and dimensions equal to one another.

A further rectangular panel 41 extends sideway from the vertical fold line 38, and it has a width equal to that of the main portion 12. A generally rectangular cut out 42 is formed at the middle of the lower edge 43 of the rectangular panel 41. The generally rectangular cut-out 42 preferably having side edges sloping downwardly and outwardly of one another is formed in the lower middle edge portion of rectangular panel 41. A mounting flap 44 extends sideway from the outer vertical fold line 45 of the outer trapezoidal shape panel 36. A common horizontal fold line 46 is formed in both the outer trapezoidal shape panel 35 and the rectangular panel 41 at a position about midway of the top edge 37 of the outer trapezoidal shape panel 35, similarly a common horizontal fold line 47 is formed in both the outer trapezoidal shape panel 36 and the mounting flap 44 at a position about midway of the top edge 39 of the outer trapezoidal shape panel 36.

The merchandise display support stand 10 is formed by attaching the mounting flap 44 to the outer vertical side edge of the rectangular panel 41. It can be understood by those skilled in the art that the rectangular panel 41 may be alternatively formed on the side of the configuration 11 with it extending from the vertical fold line 40 and the mounting flap 44 is formed on the side extending sideway from the vertical fold line 38 to provide the same purposes.

When the mounting flap 44 is attached to the outer edge of the rectangular panel 41, the main portion 12 forms the front panel and the rectangular panel 41 forms the rear panel of the merchandise display support stand 10 of the present invention. The trapezoidal shape panel 29 and the outer trapezoidal shape panel 35 form one side panel of the display stand 10 which is foldable vertically along the vertical fold line 32 by pushing the side panel inwards. The trapezoidal shape panel 30 and the outer trapezoidal shape panel 36 form the opposite right side panel of the display stand 10 which is foldable vertically along the vertical fold line 34 by pushing the right side panel inwards. The upper panel 15 is then pivoted upwards until it lies on top of the top edges 33 and 35 of the trapezoidal shape panels 29 and 30 to form a platform which is tilted slightly downwardly and inwardly toward the rectangular rear panel 41. The slots 17 and 18 engage with the lower end of the sloping top edges 37 and 39 respectively to maintain the platform mounted to the side panels of the stand.

An elastic cord 48 is connected between the lower edge portion of the foldable bracing panel 22 and the rear panel 41 of the display stand. The elastic cord 48 maintains the foldable bracing panel 22 to position normally in a horizontal position transversely across the interior of the stand with the tab 26 abutting and extending outward from the upper edge 49 of the cut out 42 to provide a brace for retaining the display stand 10 in the erected condition.

Figure 4:
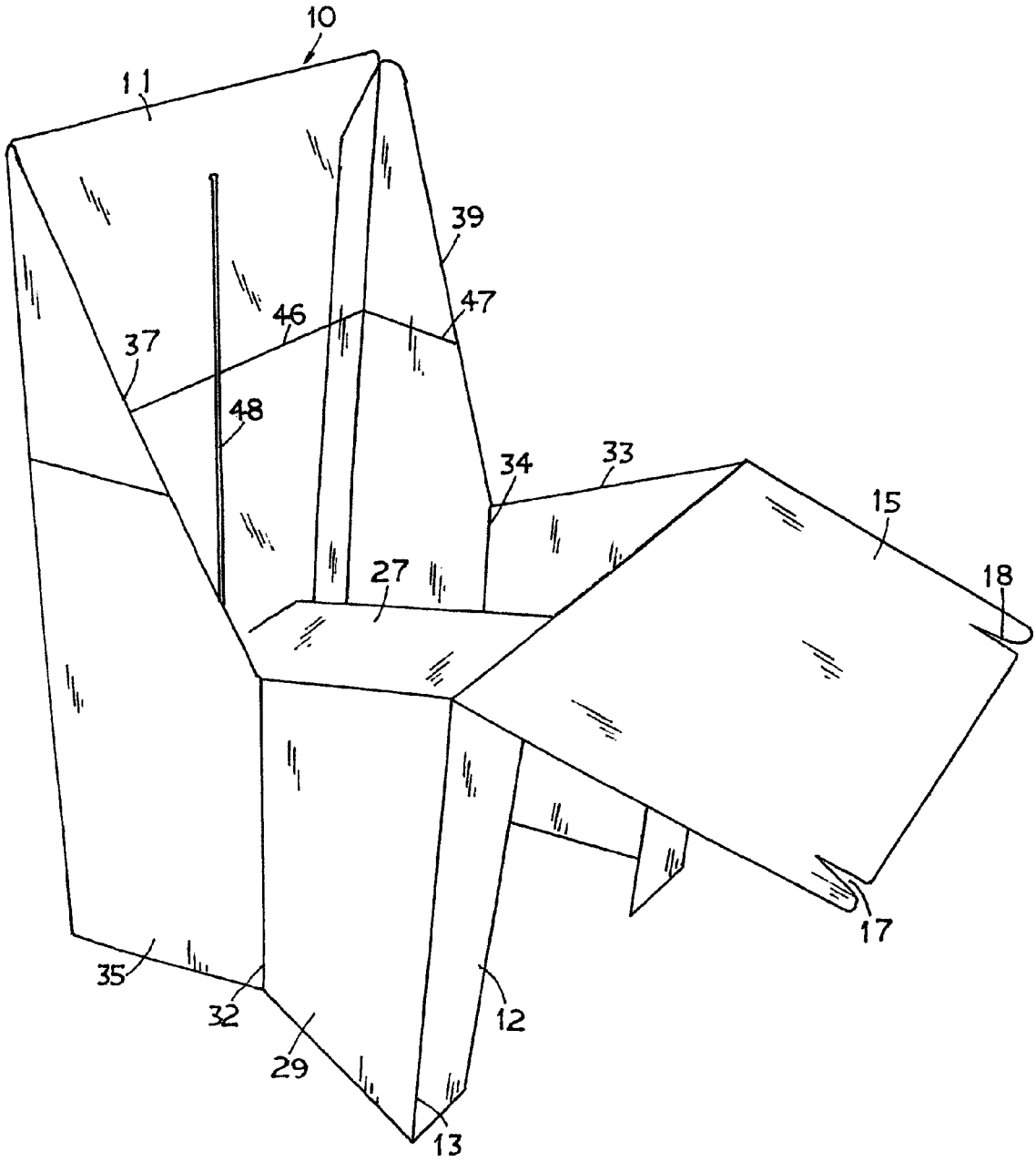
FIG. 4 is the left front and top perspective elevation view thereof with the pedestal platform turned outward to show a portion of the self-erecting bracing board located in the transverse position within the stand.
Figure 5:
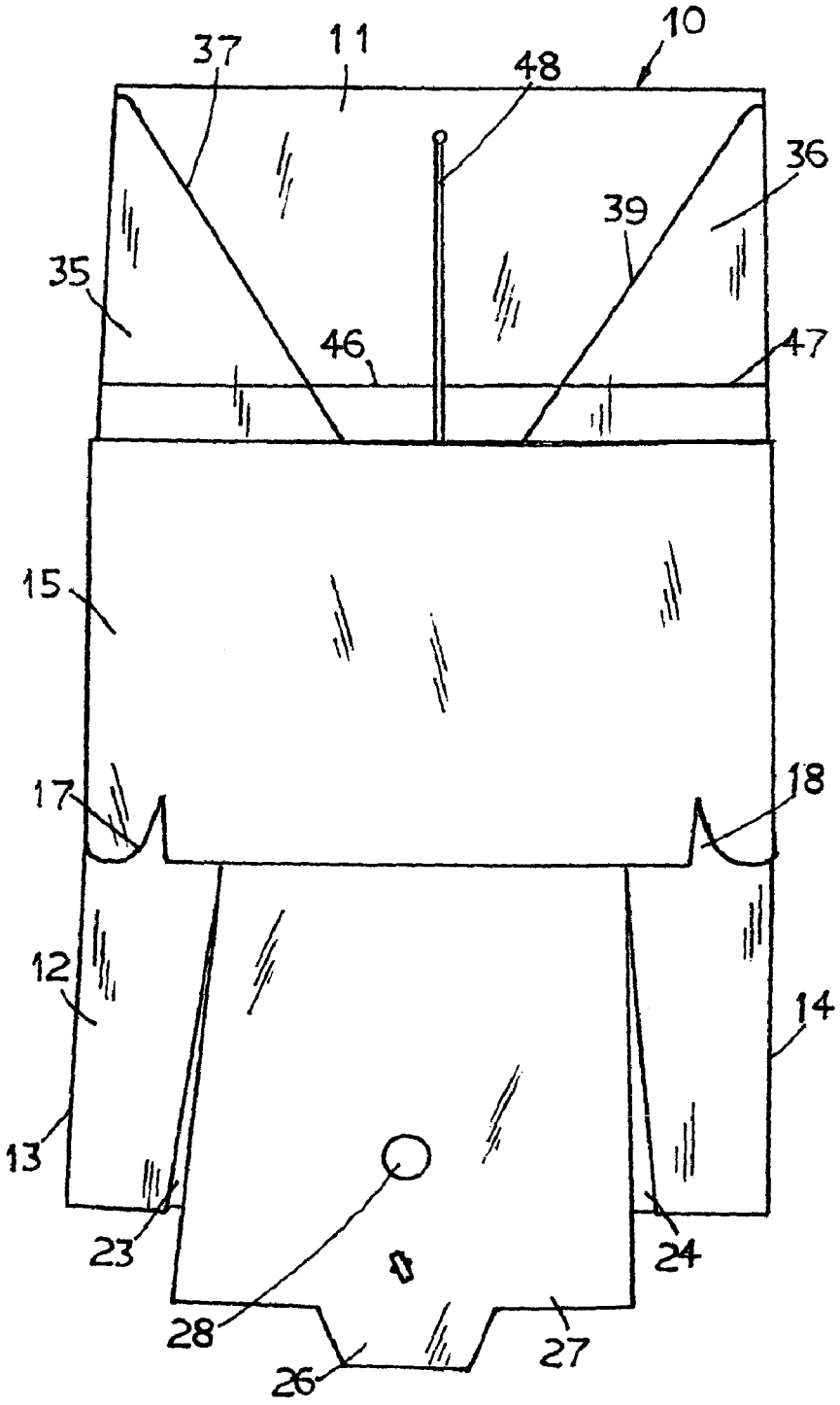
FIG. 5 is a front perspective elevation view of the display support stand in the initial folded condition with the side walls folded inwards and the pedestal platform folded outwards to lie on top of the front panel.
Figure 6:
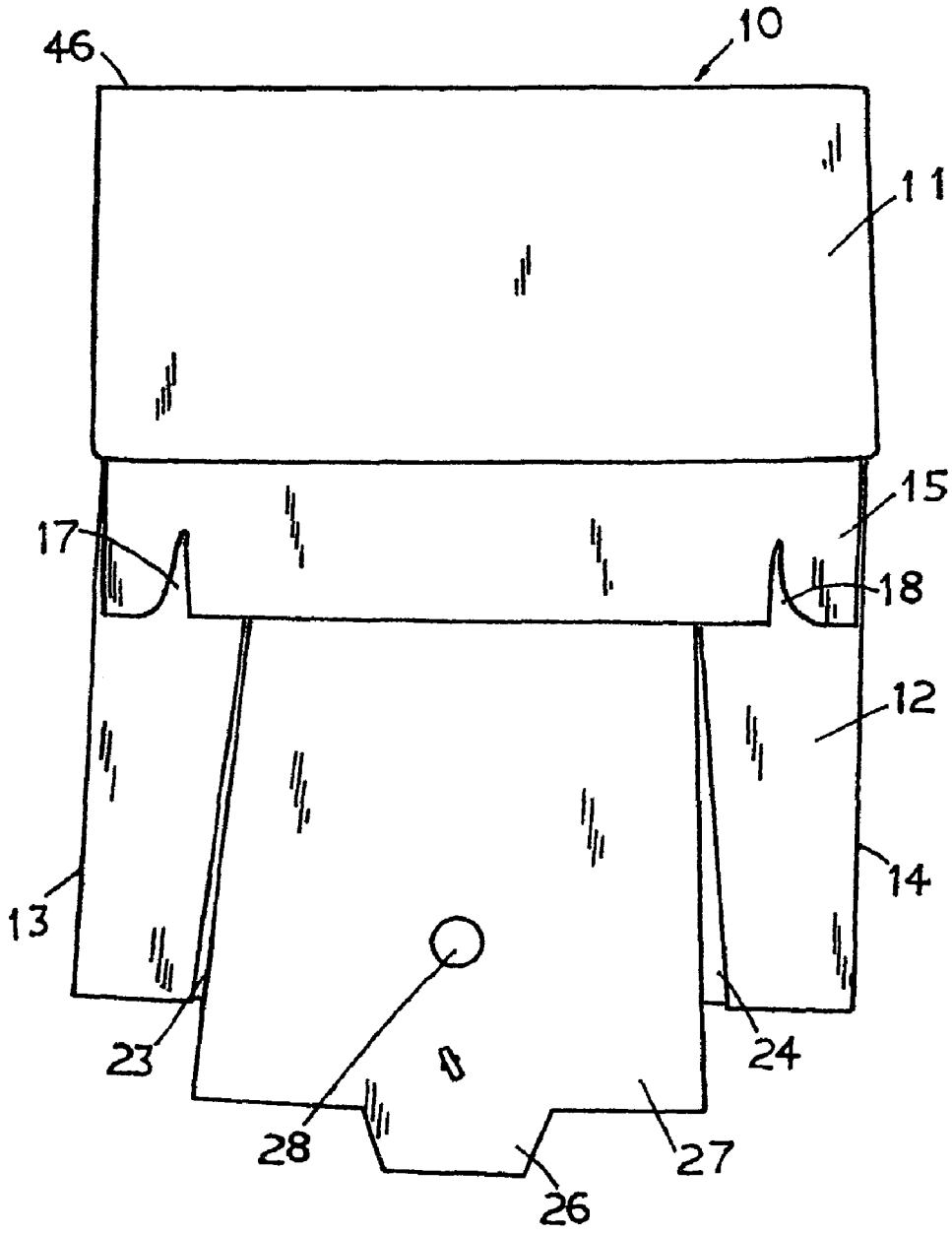
FIG. 6 is a front perspective elevation view of the display support stand in the completely folded condition with the top portion also folded over the folded pedestal platform.
Figure 7:
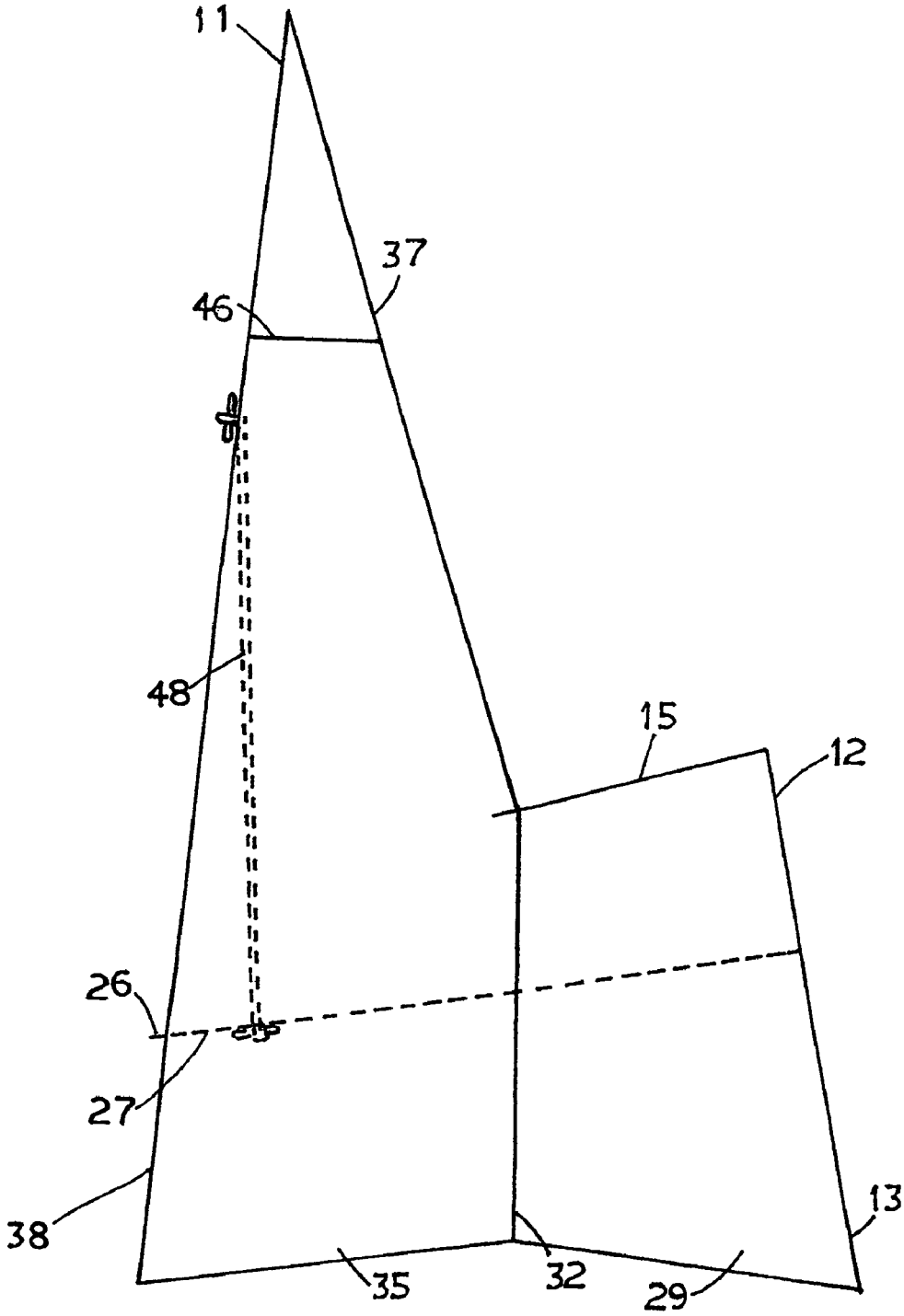
FIG. 7 is a left side perspective elevation view of the display support stand in the erected condition with the bracing board therein shown in dotted line.

The display stand 10 may be folded into a collapsed condition by first detaching the engagement of the slots 17 and 18 of the platform 15 and then pivoting the platform along the horizontal fold line 16 forwardly and outwardly as shown in FIG. 4. The foldable bracing panel 22 may then be folded downward by pivoting it against the elastic force of the elastic cord 48 until it lies close to the front panel 12 while pushing the side panels to fold inwards towards one another relative to the vertical fold lines 32 and 34 until the front panel 12 lies juxtaposed to the rear panel 41. The platform 15 may then be folded on top of the front panel 12 as shown in FIG. 5. The top portion of the rear panel and the side panels may be folded downward along the horizontal fold lines 46 and 47 until they lie on top of the folded platform as shown in FIG. 6. The display support stand 10 in the compact collapsed and folded condition is convenient for storage and transportation.

The display support stand 10 in the collapsed and folded condition may be easily and readily erected at the display site by holding the top edge of the folded rear panel 41 and then raising the unit upwards. The elastic force of the extended elastic cord 48 will automatically pull the foldable bracing panel 22 towards the horizontal position and the movement of the bracing panel 22 towards the horizontal position also forces the side panels to unfold outwards. The position of the bracing panel 22 in the horizontal position with the tab 26 abutting the upper edge 49 of the cut-out 42 maintains the stand in the erected condition. The stand is further rigidly formed by pivoting the platform 15 upwards until the slots 17 and 18 engage firmly with the lower portion of the top edges 37 and 39 to form the platform sloping rearwardly and downwardly on the support stand.

Figure 8:
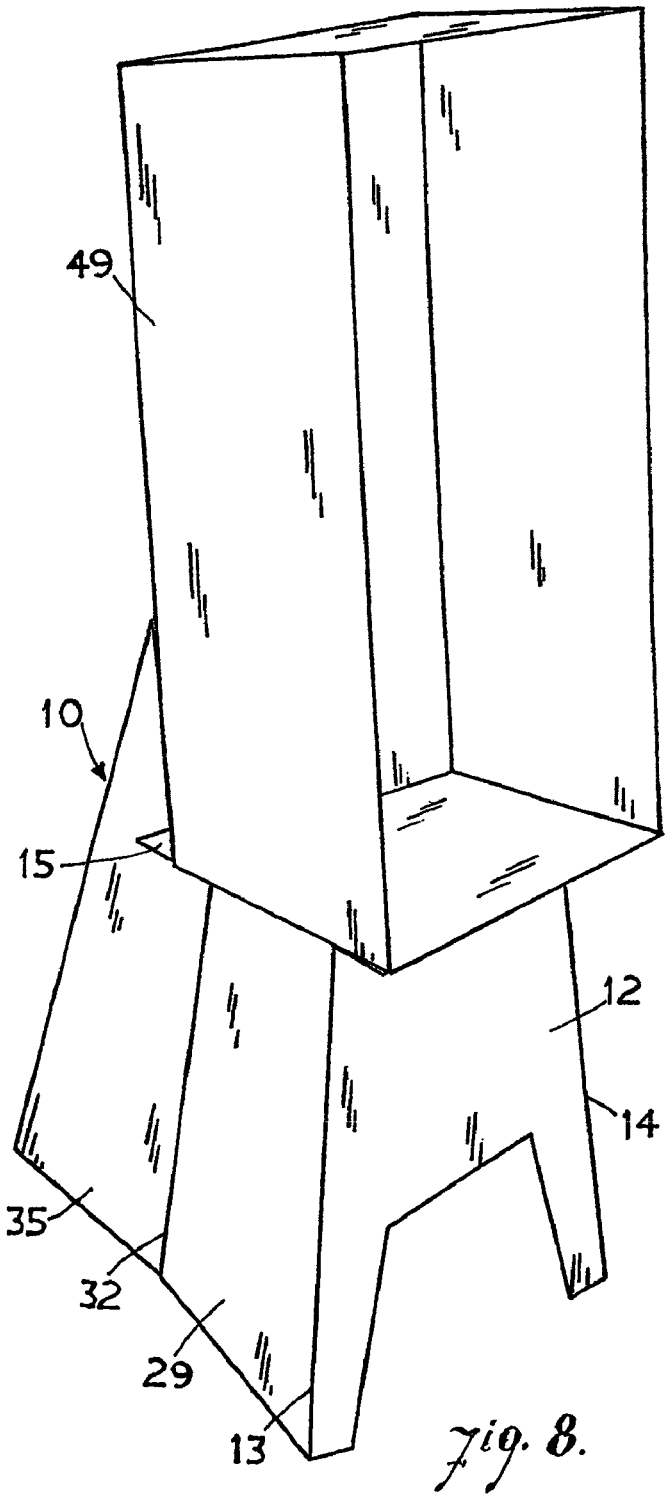
FIG. 8 is a front and top perspective elevation of the merchandise display support stand with a merchandise holding case or box placed on the pedestal platform.

Merchandise items may be placed directly on the platform 15 or contained in a rectangular case 49 placed on the platform 15 as shown in FIG. 8 to display them at the display site. The sloping top edges 37 and 39 of the outer trapezoidal shape panels form sloping supports of the rear panel of the rectangular case 49 to tilt the case 49 rearwardly at the top so as to provide a clear view of the display items in the case 49 to the purchaser.

Figure 9:
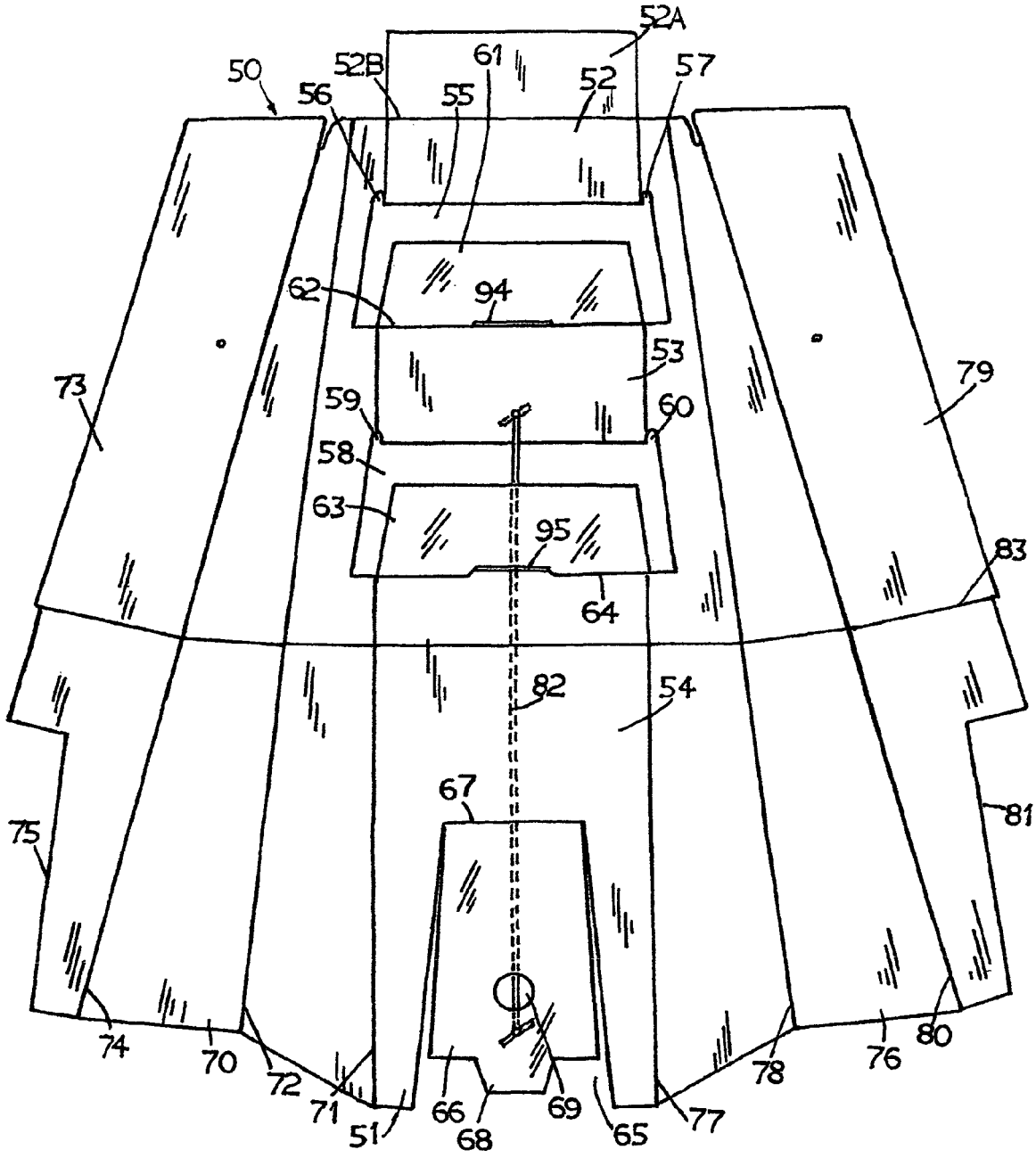
FIG. 9 is a front perspective elevation of a second embodiment of configuration of the merchandise display support stand of the present invention having two pedestal shelves formed by stamping in a single cardboard.

A second embodiment of the display support stand of the present invention having more than one platform may be formed with the configuration provided on a single cardboard. An exemplary embodiment having two platforms, for simplicity of illustration, is shown in FIG. 9.

The configuration 50 has a generally rectangular central panel 51 having an upper rectangular portion 52, a middle rectangular portion 53 and a lower rectangular portion 54. An upper generally rectangular opening 55 is located between the upper rectangular portion 52 and the middle rectangular portion 53. An upper extension rectangular panel 52A extending above the horizontal upper edge 52B of the upper rectangular portion 52. The upper extension rectangular panel 52A is foldable rearward along the horizontal upper edge 52B. The upper rectangular opening 55 has downward opened slots 56 and 57 formed at its upper corners of its upper edge. A similar middle rectangular opening 58 is formed between the middle rectangular portion 53 and the lower rectangular portion 54. The upper rectangular opening 55 and the middle rectangular opening 58 have an equal height. The middle rectangular opening 58 also has downward opened slots 59 and 60 formed at the upper corners of its upper edge. An upper pivotable panel 61 is located in the upper rectangular opening 55. The upper pivotable panel 61 is pivotable relative to the middle rectangular portion 53 along a first horizontal fold line 62. A similar middle pivotable panel 63 is formed in the middle rectangular opening 58 and it is pivotable relative to the lower rectangular portion 54 along a second horizontal fold line 64. A lower cut out opening 65 is formed in the middle lower edge portion of the lower rectangular portion 54. A generally rectangular pivotable bracing panel 66 is formed in the lower cut out opening 65. The pivotable bracing panel 66 is pivotable relative to the lower rectangular portion 54 along a third horizontal fold line 67. An extension tab 68 is formed in the middle of the lower edge of the bracing panel 66. An opening 69 is formed adjacent to the lower edge of the bracing panel 66. The opening 69 facilitates a finger to be inserted therein for pivoting the bracing panel 66 relative to the lower rectangular portion 54. A left triangular portion 70 is located on the left side of the central rectangular panel 51 and it is foldable along a left vertical fold line 71 relative to the central rectangular panel 51. Portions of the vertical fold line 71 also form the left side-edge of the upper rectangular portion 52 and the middle rectangular portion 53. The left triangular portion 70 has a vertical middle fold line 72 extending throughout the entire vertical length of the left triangular portion 70. A generally rectangular left extension portion 73 is located on the left side edge portion of the left triangular portion 70, and it is foldable relative to the left triangular portion 70 along vertical fold line 74. An inverted L-shaped cut out 75 is formed at the lower left edge portion of the left extension portion 73.

A right triangular portion 76 is located on the right side of the central rectangular panel 51, and it is foldable along a right vertical fold line 77 extending throughout the entire vertical length of the central rectangular panel 51. Portions of the vertical fold line 77 also formed the right side edges of the upper rectangular portion 52 and the middle rectangular portion 53. A vertical fold line 78 extending throughout the middle of the entire vertical length of the right triangular portion 76. A generally rectangular right extension portion 79 is located on the right side of the right triangular portion 76, and it is foldable along a vertical fold line 80 relative to the right triangular portion 76. An inverted L-shaped cut out 81 is formed at the lower right side edge portion of the right extension portion 79.

An elastic cord 82 is connected between a lower edge portion of the pivotable bracing panel 68 and the middle rectangular portion 53. The elastic cord 82 is stretched when the bracing panel 68 is located at the position parallel with the central rectangular panel 51 as best shown in FIG. 9.

A horizontal fold line 83 is formed along the middle of the entire width of the configuration 50.

Figure 10:
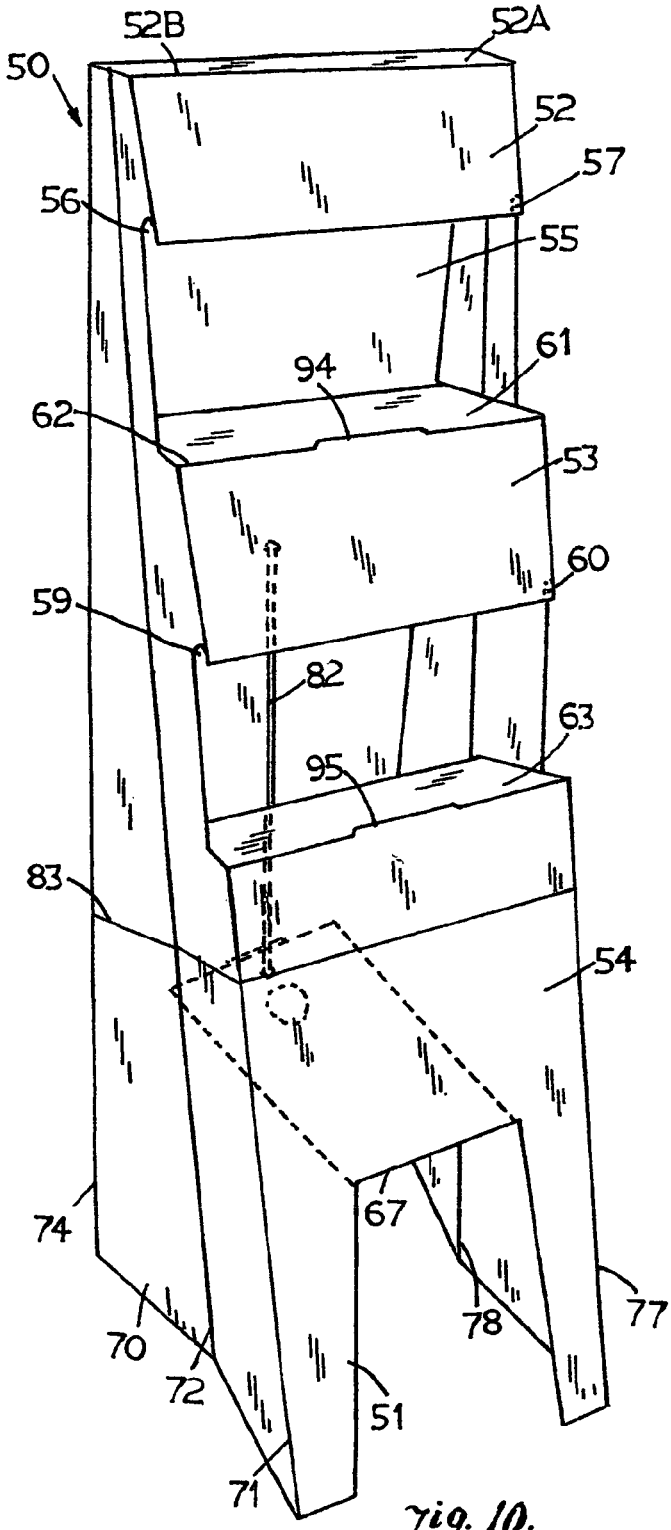
FIG. 10 is a left side and top perspective elevation of the second embodiment thereof in the erected condition.
Figure 11:
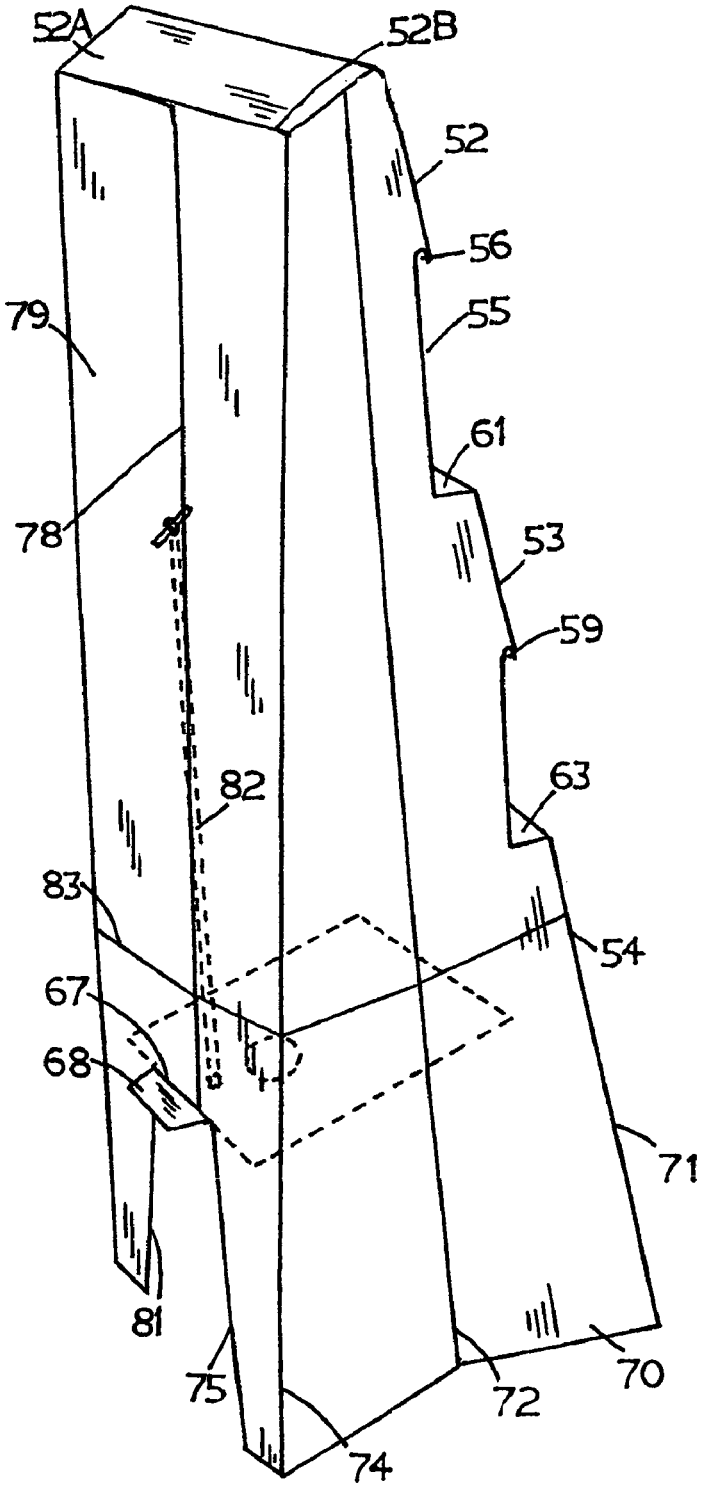
FIG. 11 is a left rear and top perspective elevation view of the second embodiment.

The second embodiment of the display support stand is formed by folding the configuration 50 along vertical fold lines 71, 77, 74 and 80 with the vertical edge portion of the left extension portion 73 overlapping and attached to the vertical edge portion of the right extension portion 79 so that the central rectangular panel 51 forms the front panel of the support stand. The overlapping left extension portion 73 and the right extension portion 79 forms the rear panel of the support stand. The left triangular portion 70 forms the left side panel of the support stand, while the right triangular portion 76 forms the right side panel of the support stand as best shown in FIGS. 10 and 11. The support stand is maintained in the erected condition by the elastic cord 82 pulling the bracing panel 66 to locate in a horizontal position within the stand with its extension tab 68 abutting the upper edge of the cut out in the rear panel of the stand formed by the combination of the inverted L-shaped cut outs 75 and 81. Support platforms are formed by turning the upper pivotable panel 61 along the horizontal fold line 62 to locate in a generally horizontal position within the upper rectangular opening 55 and the middle pivotable panel 63 along the horizontal fold line 64 to a generally horizontal position within the middle rectangular opening 58.

The upper rectangular extension panel 52A is foldable along the horizontal fold line 52B rearward to cover over the top of the stand 50.

The display support stand may be folded into a collapsed condition by pivoting the bracing panel 66 downwards while pushing the side panels inwards to fold along the vertical fold lines 72 and 78 until the front panel lies juxtaposed to the rear panel. The collapsed stand may then be folded to about half its vertical length by folding the top portion forward along the horizontal fold line 83 until the top portion lies on top of the lower portion.

To erect the display support stand, it is unfolded along the horizontal fold line 83 by holding the folded top portion and raising the entire folded stand upwards, the elastic force of the stretched elastic cord 82 will automatically pull the bracing panel 66 to the transverse position with its extension tab 68 abutting the upper edge of the cut-out in the rear panel of the stand. The movement of the bracing panel 66 to the transverse position it will also force the side panels to unfold outwards for unfolding the stand to the erected condition. The entire erection operation can easily be carried out by a single person.

Figure 14A:
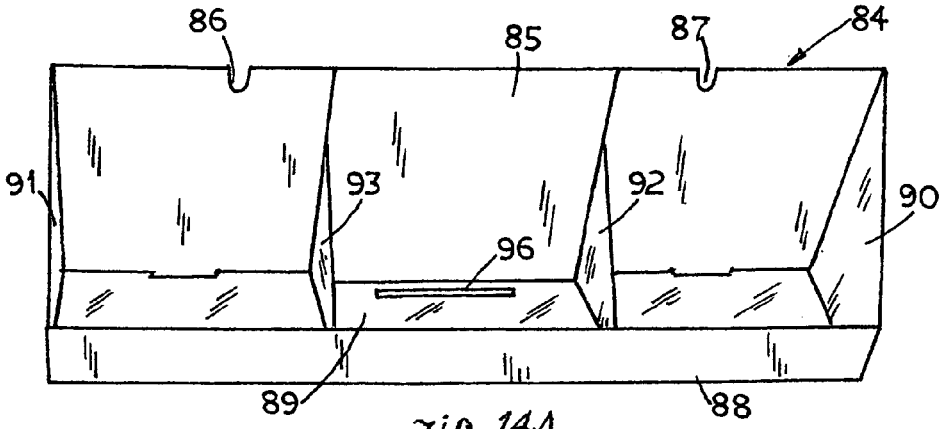
FIGS. 14A and 14B are top front and top rear perspective views respectively of the removably mountable merchandise holding trays of the second embodiment.
Figure 14B:
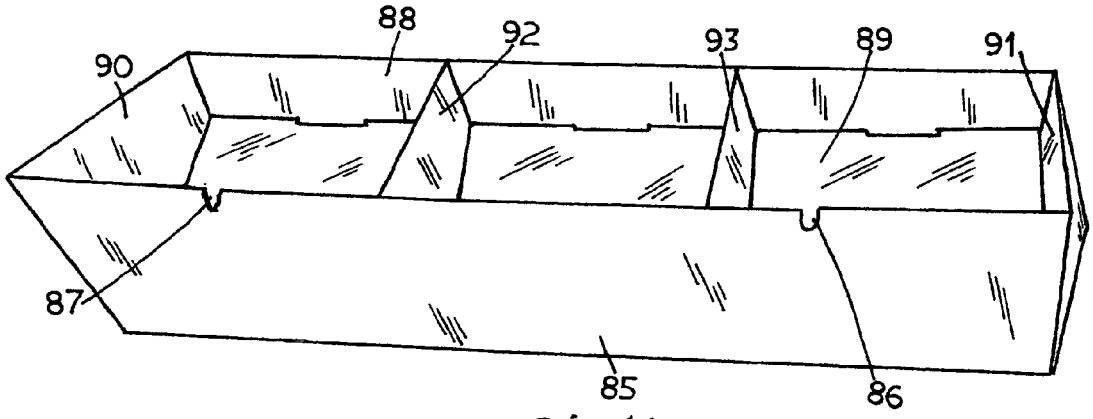

A merchandise display tray 84 may be removably mounted at each to the stand in the erected condition so that merchandise items may be placed in the display trays 84 on each support platform for display and sale. The merchandise tray 84 as best shown in FIGS. 14A and 14B has a width larger than the width of the display support stand. It has a rear panel 85 having a height equal to the height of the upper rectangular opening 55 and the middle rectangular opening 58. Two opened top vertical slots 86 and 87 are formed in the upper edge of the rear panel 85. The vertical slots 86 and 87 are spaced from one another equal to the upper rectangular portion 52 and the middle rectangular portion 53 of the front panel of the stand. The tray 84 has a front panel 88 having a height lower than the rear panel 85, and a rectangular bottom panel 89, and two trapezoidal side panels 90 and 91. The upper edge of the side panels 90 and 91 slopping downward from the higher rear panel 85 to the lower front panel 88. Trapezoidal shaped reinforcing panels 92 and 93 are provided in the tray 84 for strengthening the tray. The reinforcing panels 92 and 93 may also serve as partitions in the tray for separating various displayed merchandise items particularly various different merchandise items having relatively small physical sizes.

Figure 12:
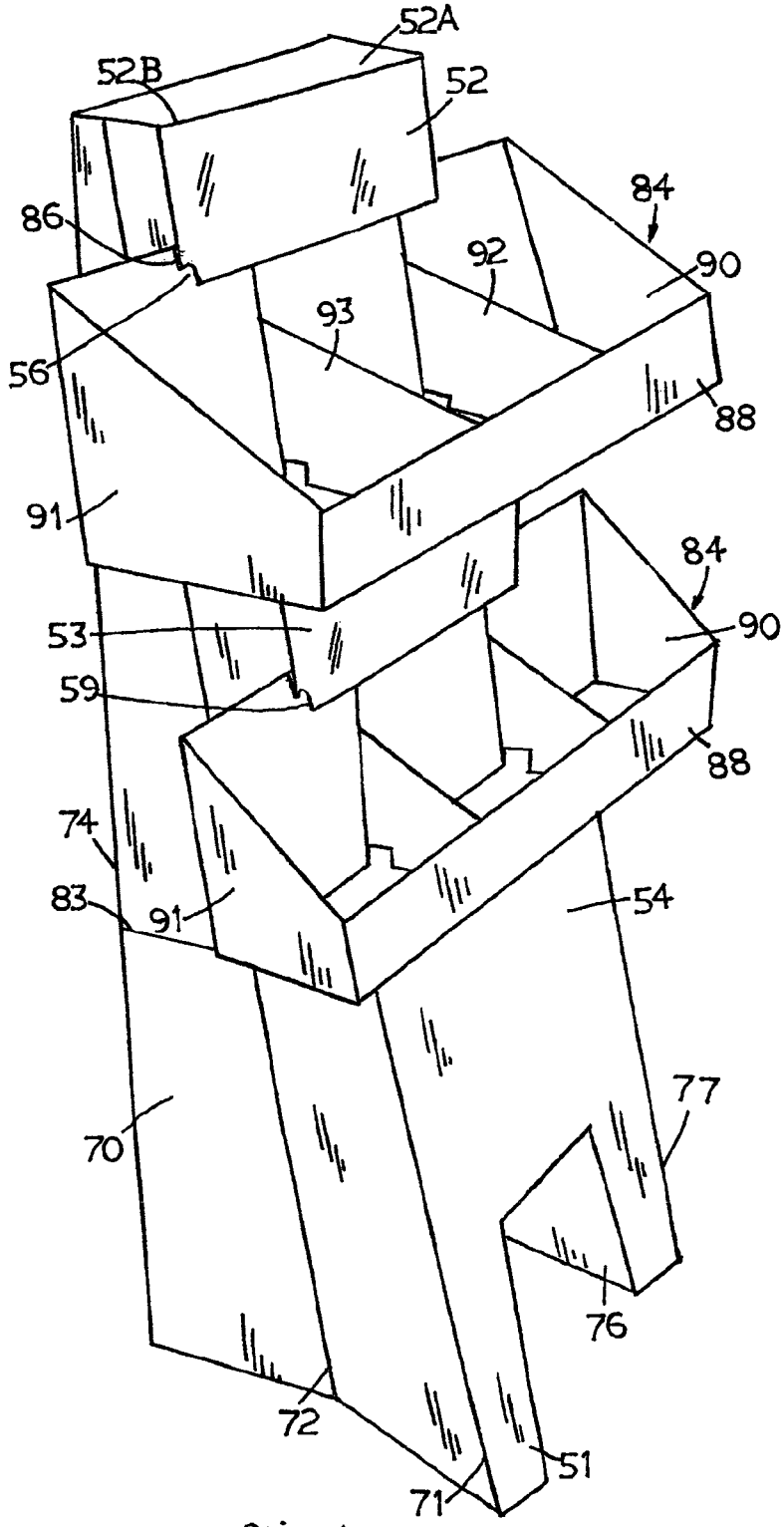
FIG. 12 is a side and top perspective elevation of the second embodiment with merchandise holding trays removably mounted thereon.
Figure 13:
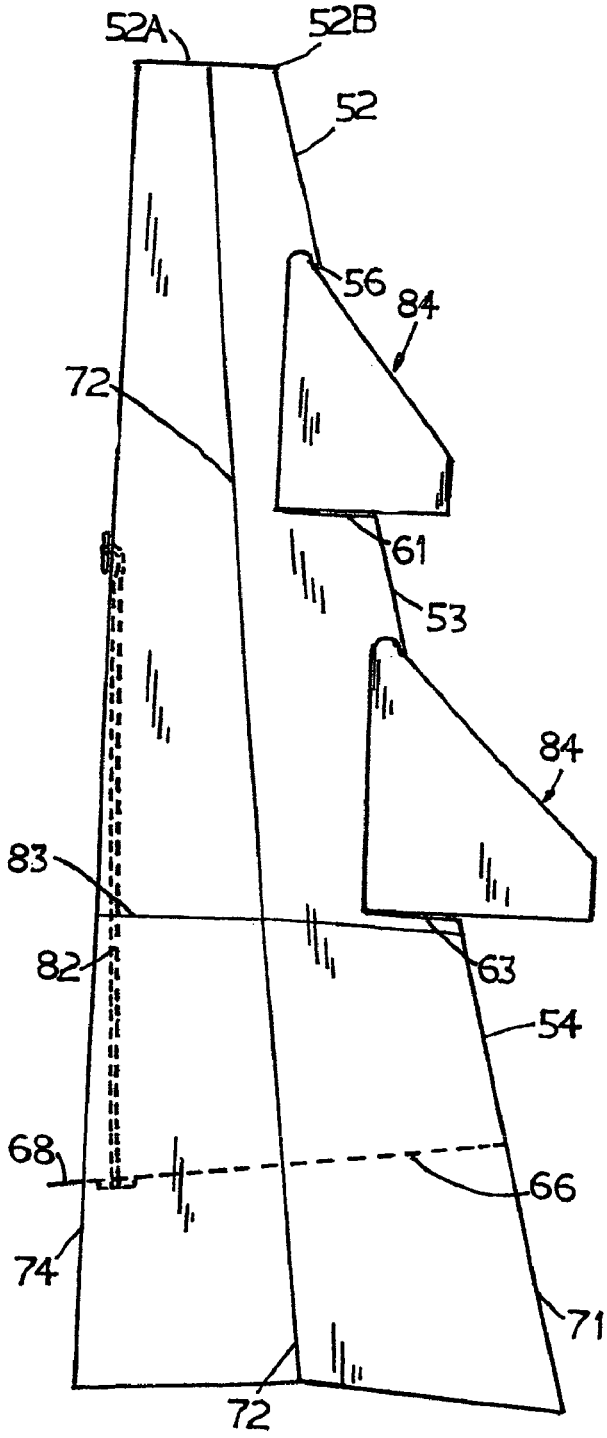
FIG. 13 is a left side perspective elevation view of the second embodiment with the merchandise holding trays mounted thereon and the bracing board in the transverse position in the stand shown in a dotted line.

The display tray 84 may be mounted for example to the display stand by first inserting the rear panel 85 upwards in a tilted angle upwards into the upper rectangular opening 52 of the display stand with the open slots 86 and 87 engaging with the downward opened slots 56 and 57 at the upper edge of the upper rectangular opening 52 respectively, then the tray is pushed inwards into the rectangular opening 52 until it rear edge portion of its bottom panel 89 rests securely on the front edge portion of platform 61 as best shown in FIGS. 12 and 13. A second display tray may also be mounted in the middle rectangular opening 58 in the similar manner. The display tray may be removed from the rectangular openings in the reverse manner.

An inverted U-shaped form 94 may be stamped at the middle portion along the horizontal fold line 62 of the upper pivotal panel 61, similarly an inverted U-shaped form 95 is stamped at the middle portion along the horizontal fold line 64 of the middle pivotal panel 63 as shown in FIG. 9. Upstanding rectangular tabs 94 and 95 will be formed at the front edge of the support platforms respectively as shown in FIG. 10 when the pivotal panels 61 and 63 are pivoted to the horizontal position to form the support platforms. A rectangular opening 96 having a length equal to the rectangular tabs 94 and 95 at the support platforms is formed at the middle of the rear edge portion of the bottom panel 89 of the display tray 84. The rectangular opening 96 will engage with the rectangular tabs 94 and 95 respectively when the display tray 84 is mounted to the display stand to avoid accidental disengagement of the display tray 84 from the mounted position in the display support stand.

While the present invention has been shown and described in the preferred exemplary embodiments thereof, it will be apparent that various modifications can be made therein without departing from the spirit or essential attributes thereof, and it is desired therefore that only such limitations be placed thereon as are imposed by the appended claims.

What is claimed is:

1. A merchandise display support stand comprising, all component parts formed by a single configuration stamped from a single cardboard, said component parts including a generally rectangular main portion panel having two vertical side edges forming two vertical fold lines, a generally rectangular pivotable panel located at a lower middle portion of said main panel, said pivotable panel being pivotable along a first horizontal fold line between said pivotable panel and said main panel, said pivotable panel having side edges separated from said main panel by two vertical slots formed between said side edges of said pivotable panel and said main panel, a generally rectangular upper panel extending upward from a top edge of said main panel, and said top edge forming a second horizontal fold line, said upper panel being foldable relative to said main panel along said second horizontal fold line, two vertical opened slots formed at an upper edge of said upper panel, said opened slots being spaced from one another and located adjacent to side edges of said upper panel, a vertically foldable first side panel extending sideway from one vertical side edge of said main panel, and a vertically foldable second side panel extending sideway from the second vertical side edge of said main panel, each of said first side panel and said second side panel having a middle vertical fold line, a generally rectangular rear panel extending sideway from a common vertical side edge of one of said first side panel and second side panel, a rectangular downwardly extending opened cut-out formed in a middle lower edge of said rear panel.

2. A merchandise display support stand according to claim 1 wherein said first side panel includes a first trapezoidal shape panel extending sideway from said first side edge of said main panel, said middle vertical fold line forming an outer edge of said first trapezoidal shape panel, a second trapezoidal shape panel extending sideway from said middle vertical fold line, and said second side panel includes a third trapezoidal shape panel extending sideway from a second side edge of said main panel, said middle vertical fold line forming an outer edge of said third trapezoidal shape panel, and a fourth trapezoidal shape panel extending sideway from said middle vertical fold line of said second side panel.

3. A merchandise display support stand according to claim 2 wherein said first trapezoidal shape panel has a top edge sloping upward from a side end of said first horizontal fold line to a top end of said vertical middle fold line of said first side panel, and said second trapezoidal shape panel has a top edge sloping downward from a top end of said common vertical side edge to said top end of said vertical middle fold line of said first side panel, and said third trapezoidal shape panel has a top edge sloping downward from a second side end of said horizontal fold line to a top end of said vertical middle fold line of said second side panel, and said fourth trapezoidal shape panel has a top edge sloping downward from a top end an outer upper corner to a top end of said middle vertical fold line of said second side panel.

4. A merchandise display support stand according to claim 3 including a mounting flap extending sideway from an outer side edge of said fourth trapezoidal shape panel, said mounting flap being attachable to a vertical outer edge portion of said rear panel for forming said display support stand in an erected condition.

5. A merchandise display support stand according to claim 4 including an elastic cord connected to said pivotal panel and to said rear panel, said elastic cord retaining said pivotal panel normally in a transverse position within said stand to form a bracing panel for maintaining said stand in said erected condition.

6. A merchandise display support stand according to claim 5 wherein said upper panel is foldable along said first horizontal fold line to lie on said top edge of said first trapezoidal panel and said third trapezoidal panel with said opened slots engaging with said top edge of said second trapezoidal panel and said fourth trapezoidal panel.

7. A merchandise display support stand according to claim 6 including an operation opening formed in said pivotal panel to facilitate insertion of a finger in said pivotal panel for pivoting said pivotal panel relative to said front panel.

8. A merchandise display support stand according to claim 7 including a third horizontal fold line formed along an upper portion of said second trapezoidal shape panel and said rear panel, said third horizontal fold line being aligned with said second horizontal line, a fourth horizontal fold line formed along an upper portion of said fourth trapezoidal shaped panel, said fourth horizontal fold line also aligned with said second horizontal line.

9. A merchandise display support stand comprising, all component parts formed by a single configuration stamped from a single cardboard, said component parts including a generally rectangular main panel having two vertical side edges forming two vertical fold lines, a generally rectangular pivotable brace panel extending downwardly at a lower middle portion of said main panel, said brace panel being foldable along a first horizontal fold line between said brace panel and said main portion, and said brace panel having side edges separated from said main panel by two vertical slots formed between said side edges of said brace panel and said main panel, a first rectangular opening located above said main panel, a rectangular first upper pivotable panel located in said first rectangular opening, said first upper pivotable panel being foldable relative to said main panel along a first horizontal fold line located between said main panel and said first rectangular opening, a second rectangular opening located above an upper portion of said main panel, a rectangular second upper pivotable panel located in said second rectangular opening, said second upper pivotable panel being foldable relative to said main panel along a third horizontal fold line located between said main panel and said second rectangular opening, two downward opened slots formed at two corners of an upper side edge of said first rectangular opening and said second rectangular opening, a vertically foldable first side panel extending sideway from one vertical side edge of said main panel, and a vertically foldable second side panel extending sideway from the second vertical side edge of said main panel, said first side panel and said second side panel being foldable vertically along a middle vertical fold line, a first outer panel extending sideway from a vertical outer edge of said first side panel, said first outer panel being foldable vertically along said outer edge relative to said first side panel, a second outer panel extending sideway from a vertical outer edge of said second side panel, said second out panel being foldable vertically along said outer edge of said second side panel relative to said second side panel, a first inverted L-shaped cut out formed in an outer lower corner of said first outer panel, a second inverted L-shaped cut out formed in an outer lower corner of said second outer panel, said first outer panel and said second outer panel being attachable to one another to form a rear panel of said stand in an erected condition, and said first inverted L-shaped cut out and said second inverted L-shaped cut out being cooperative with one another to form a downwardly extending cut out opening in said rear panel when said first outer panel and said second outer panel are attached to one another.

10. A merchandise display support stand according to claim 9 including an elongated elastic cord connected between said brace panel and said main panel, said elastic cord being operative for retaining said brace panel in transverse manner inside said stand in said erected condition, and said first upper pivotable panel being foldable to form a first support platform of said stand in said erected condition, and said second upper pivotable panel being foldable to form a second support platform of said stand in said erected condition.

11. A merchandise display support stand according to claim 9 including an inverted U-shaped stamping formed at a middle portion of said first upper pivotable panel and said second upper pivotable panel, said U-shaped stamping forming an upstanding tab at a middle front edge portion of said first support platform and said second support platform.

12. A merchandise display support stand according to claim 11 including a merchandise display tray removably mounted in said first rectangular opening and said second rectangular opening.

13. A merchandise display support stand according to claim 12 wherein said merchandise display tray has a rear panel with two upward opened slots formed in an upper edge of said rear panel, said upward opened slots being engageable with said downward opened slots formed at said upper corners of said upper edge of said first rectangular opening and said second rectangular opening when said tray is removably mounted at said first rectangular opening and said second rectangular opening with a bottom panel resting on said first support platform and said second support platform respectively.

14. A merchandise display support stand according to claim 13 including an elongated rectangular opening formed at a middle rear edge portion of said bottom panel of said tray, said elongated rectangular opening being engageable with said upstanding tab of said first support platform and said second support platform when a tray is mounted in said first rectangular opening and in said second rectangular opening.

15. A merchandise display support stand according to claim 14 including an operation opening formed in said brace panel to facilitate insertion of a finger therein for pulling said brace panel to pivot downward for folding said stand to a collapsed folded condition.

* * * * *